United States Patent [19]

Oi et al.

[11] Patent Number: 5,063,976

[45] Date of Patent: Nov. 12, 1991

[54] ATTACHMENT OF GAS CHARGER FOR GAS CONTAINER

[75] Inventors: Akira Oi; Keitaro Yonezawa, both of Amagasaki, Japan

[73] Assignee: Kabushiki Kaisha NERIKI, Amagasaki, Japan

[21] Appl. No.: 591,239

[22] Filed: Oct. 1, 1990

[30] Foreign Application Priority Data

Sep. 29, 1989 [JP] Japan ..... 1-256361

[51] Int. Cl.[5] ..... B65B 31/06

[52] U.S. Cl. ..... 141/18; 137/493.9; 137/509; 251/151

[58] Field of Search ..... 137/509, 493, 493.9, 137/588, 543.19; 251/149.9, 151; 141/18, 46

[56] References Cited

U.S. PATENT DOCUMENTS 2,645,241 7/1953 Riede ..... 141/18
3,513,872 5/1970 Tupper et al. ..... 137/543.19 X
3,580,274 5/1971 Hansen ..... 137/509 X
4,210,168 7/1980 Yonezawa ..... 141/18 X
4,341,245 7/1982 Daicho et al. ..... 137/507 X

*Primary Examiner*—Stephen M. Hepperle
*Attorney, Agent, or Firm*—Foley & Lardner

[57] ABSTRACT

An attachment of a gas charger for a gas container is adapted to be mounted to a valve device with a check valve and to be used for forcedly opening a spring-closed type check valve by means of a charging pressure of a fresh gas. The attachment is provided with a gas charging mouthpiece detachably secured to a valve box of the valve device, a piston supporting member movable together with the gas charging mouthpiece, and a valve-opening piston. The valve-opening piston is sealingly supported by the piston supporting member in such a condition as being freely movable in the diametrical direction and is detachably sealingly fitted into a received pressure removing cylinder room of a check valve member.

7 Claims, 9 Drawing Sheets

ATTACHMENT OF GAS CHARGER FOR GAS CONTAINER

BACKGROUND OF THE INVENTION

1. Field of the Invention

The present invention relates to an attachment of a gas charger adapted to be used for charging a gas container with a compressed gas or a liquified gas. The attachment is adapted to be connected to a gas outlet nozzle of a valve device with a check valve, as a primary valve of the gas container and serves to admit the gas into the gas container when the spring-closed type check valve within the valve unit is opened by means of a pressure of a fresh gas to be charged.

2. Prior Art

Since the aforementioned valve device with the check valve has the following advantages, it has been widely used as the primary valve of the gas container. That is, during the take-out of the gas from the gas container, a resilient force of a valve-closing spring of the check valve is adapted to prevent a residual gas pressure within the gas container from being lowered below a predetermined value. Therefore, the atmosphere and foreign substances within the atmosphere can be prevented from entering the gas container. As a result, the interior of the gas container can be kept clean so that it is possible to omit cleaning work before a fresh gas charging. Further, in the case that different kinds of gases taken out of a plurality of gas containers are mixed for use, the check valve can prevent the gas from reversely flowing from a high pressure side gas container to a low pressure side gas container even though a differentiated residual pressure is provided between the gas containers.

When a fresh gas is charged into an evacuated gas container connected to a gas charging station, the attachment as a subject of the present invention, is connected to the gas outlet nozzle of the valve device with the check valve, and the check valve is automatically opened by means of a pressure of the fresh gas.

Such an attachment, there has been disclosed in U.S. Pat. No. 4,341,245 (Daicho et. al.) (referred to as the 245 Patent hereinafter) which was previously proposed by one of the inventors of the present invention. Respective attachments described in this prior art are provided with a gas charging mouthpiece which was connected to a valve box of the valve device and a valve-opening piston which was fitted to a check valve member of the check valve so as to be manipulated thereby, and are classified according to the following first, second and third conventional embodiments.

First Conventional Embodiment (refer to FIG. 11 corresponding to FIG. 10 of the 245 Patent)

In this embodiment, a valve-opening piston 149 is formed as a separate component part with respect to a gas charging mouthpiece 156, and a manipulation knob 191 is outwardly projected from the valve-opening piston 149. When a gas is charged, first an operator holds the manipulation knob 191 with his/her fingers to sealingly fit the valve-opening piston 149 to a received pressure removing cylinder room 148 of a check valve 142 through a sealing member 150 and then sealingly connects the gas charging mouthpiece 156 to a gas outlet nozzle 106 by means of a connection cap nut 157.

Second Conventional Embodiment (refer to FIG. 12 corresponding to FIG. 3 of the 245 Patent)

In this embodiment, a valve-opening piston 249 is swingably supported at its back end portion by the leading end portion of a gas charging mouthpiece 256 through a pivot pin 292.

Third Conventional Embodiment (refer to FIG. 13 corresponding to FIG. 8 of the 245 Patent)

In this embodiment, the back end portion of a valve-opening piston 349 is fixedly secured to the leading end portion of a gas charging mouthpiece 356.

Now, in order to prevent breakage accidents which might be caused by an overturn and/or a collision with other bodies during a transportation or a storage of the gas container, the valve device with the check valve is required to be covered by a protection cap. Since the protection cap is apt to be mounted to the neck portion of the gas container having a small outer diameter, an inner diameter of the cap is limited to a small value. Therefore, the gas outlet nozzle 106, 206, 306 must have a small value of a projecting dimension from the valve box.

Then, in order to effectively connect the gas charging mouthpiece 156, 256, 356 to the gas outlet nozzles 106, 206, 306 at the time of gas charging, it is necessary to manufacture the mouthpieces 156, 256, 356 with a small external dimension and having a light weight. Thereby, the gas charging bores 193, 293, 393 of the gas charging mouthpieces 156, 256, 356 have an inner diameter which is limited to a small value.

Further, in order to prevent the body portion of the valve-opening pistons 149, 249, 349 from outwardly projecting from the leading end surface of the gas outlet nozzles 106, 206, 306 when the gas charging mouthpieces 156, 256, 356 is connected to the gas outlet nozzles 106, 206, 306, it is necessary to dispose the check valve members 142, 242, 342 in the deep portion of the gas outlet nozzles 106, 206, 306.

Due to the above-mentioned background, the following problems are associated with the respective conventional embodiments.

First Conventional Embodiment (refer to FIG. 11)

Since the gas outlet nozzle 106 is projected a short distance from the valve box, the manipulation knob 191 of the valve-opening piston 149 must be put into the gas charging bore 193 which has a small inner diameter. Therefore, the manipulation knob 191 must be formed small in external dimension and hence it becomes difficult to hold the knob 191 by fingers. As a result, it is time and labor-consuming to put the valve-opening piston 149 into the received pressure removing cylinder room 148 at the time of gas charging work, and the working efficiency is low. Concerning this problem, since it becomes more difficult to hold the manipulation knob 191 when the operator's fingers become numb from the cold as during the performance of gas charging work in a cold season or when the operator puts on gloves, the working efficiency is remarkably lowered.

Further, in the case where the valve-opening piston 149 is slightly put into the cylinder room 148 of the check valve member 142, there is concern that the sealing member 150 will move out of the leading end portion of the slide fitting surface 151 of the cylinder room 148 when the piston 149 is subjected to a vibration and/or a collision with other bodies. In this case, at the time of gas charging, the charge gas enters the cylinder room 148, so that it becomes impossible to open the check valve member 142 by means of a charge gas pressure.

Thus, in the construction of the first conventional embodiment there is a room left for improvement because it is so difficult to hold the manipulation knob 191 by the operators fingers which lowers the working efficiency. In addition it is apprehended that the check valve member 142 only occasionally happens to open.

Second Conventional Embodiment (refer to FIG. 12)

This embodiment has an advantage that the valve-opening piston 249 can be inserted into the cylinder room 248 at the same time as the gas charging mouthpiece 256 is connected to the gas outlet nozzle 206 by the connection cap nut 257 at the time of gas charging work.

However, since the slide fitting surface 251 of the check valve member 242 is disposed at the deep portion of the gas outlet nozzle 206, the swingable leading end portion of the valve-opening piston 249 can't help by being fitted to the slide fitting surface 251 by means of groping. Therefore, the construction of the second conventional embodiment is requires improvement for enhancing its working efficiency.

Third Conventional Embodiment (refer to FIG. 13)

This embodiment has the same advantage as that of the above-mentioned second conventional embodiment but has the following problems.

That is, since there is a diametrical fitting gap between the peripheral wall surface of the check valve chamber 315 and the external peripheral surface of the check valve member 342, the axis of the check valve chamber 315 is offset relative to the axis of the cylinder room 348. Then, since there is a diametrical fitting error between the internal surrounding surface of the cap nut 357 and the flange 356*a* of the gas charging mouthpiece 356 or between the peripheral wall 306*b* of the gas outlet nozzle 306 and the gas charging mouthpiece 356, the axis of the gas outlet nozzle 306 is also offset relative to the axis of the valve-opening piston 349.

Owing to the aforementioned eccentricity, it is apprehended that the cylindrical wall portion 342*a* of the check valve member 342 is held between the valve-opening piston 349 fixedly secured to the gas charging mouthpiece 356 and the peripheral wall 306*b* when the gas charging mouthpiece 356 is connected to the gas outlet nozzle 306. Thereupon, in the case that the sealing member 350 becomes hard due to its property change after a long time or from lack of lubrication, a frictional securing force produced by the aforementioned holding becomes larger than the valve-opening force acting on the check valve member 342 by the charge gas pressure, so that occasionally it becomes impossible to open the check valve member 342. As a result, it becomes impossible to charge the gas container with the gas.

SUMMARY OF THE INVENTION

It is an object of the present invention to enhance working efficiency at the time of connection of an attachment which is compatible with a prevention of an erroneous gas charging which might be caused by an erroneous valve-opening of a check valve member.

For accomplishing the above-mentioned object, the present invention is directed to improving the attachment having the conventional construction, as follows.

A piston supporting member is formed in the leading end portion of a gas charging mouthpiece in such a condition as to be able to move together therewith in the attaching and detaching direction of the gas charging mouthpiece. A valve-opening piston is supported by the piston supporting member in such a condition as to be freely movable in the diametrical direction thereof, and the valve-opening piston is detachably inserted into a received pressure removing cylinder room. The received pressure removing cylinder room is sealed by means of a first sealing member interposed in the fitting clearance between the cylinder room and valve-opening piston, and the gap between the valve-opening piston and the piston supporting member is sealed by a second sealing member.

Since the present invention is constructed as mentioned above, the following advantages can be provided.

Since the valve-opening piston is so arranged as to be movable together with the gas charging mouthpiece through the piston supporting member, an operation to insert the valve-opening piston into the received pressure removing cylinder room of the check valve member and an operation to bring the gas charging mouthpiece into contact with the valve box of the valve device can be continuously carried out, so that it doesn't become troublesome to perform the connecting operation of the attachement.

Further, when the valve-opening piston is inserted into the received pressure removing cylinder room of the check valve, it freely moves in the diametrical direction so as to automatically perform its alignment. Therefore, the check valve member can be prevented from being frictionally locked by a seizing with the valve-opening piston. As a result, the check valve member can be smoothly opened by means of a pressure of the fresh gas to be charged.

Accordingly, both the improvement of the working efficiency for connecting the attachment and the prevention of the improper charging caused by an erroneous valve-opening of the check valve member can be made compatible.

BRIEF DESCRIPTION OF THE DRAWINGS

The invention is further described by way of illustrated embodiments with reference to the annexed drawings, in which:

FIGS. 1 through 4 show a first embodiment,

FIG. 1 is a vertical sectional front view of a valve device with a check valve, FIG. 2 is a sectional view taken along the II—II directed line in FIG. 1, FIG. 3 shows the valve device in the condition that an attachment has been connected thereto and is a view corresponding to FIG. 2, FIG. 4 is an explanatory view of the operations of the check valve and the attachment and is an enlarged view of a principal portion of FIG. 3, FIGS. 5 through 7 show a second embodiment, FIG. 5 is an explanatory view of the operations of the check valve and the attachment and a view corresponding to FIG. 4, FIG. 6 is an exploded perspective view of a lock means in FIG. 5, FIG. 7 shows the state in which the attachment is connected to the valve device without the check valve and a view corresponding to FIG. 5, FIGS. 8, 9 and 10 are partial views showing a variant respectively.

DESCRIPTION OF THE PREFERRED EMBODIMENTS

Now, embodiments of the present invention will be explained with reference to the drawings hereinafter.

FIRST EMBODIMENT

FIGS. 1 through 4 show a first embodiment.

Figure 1:
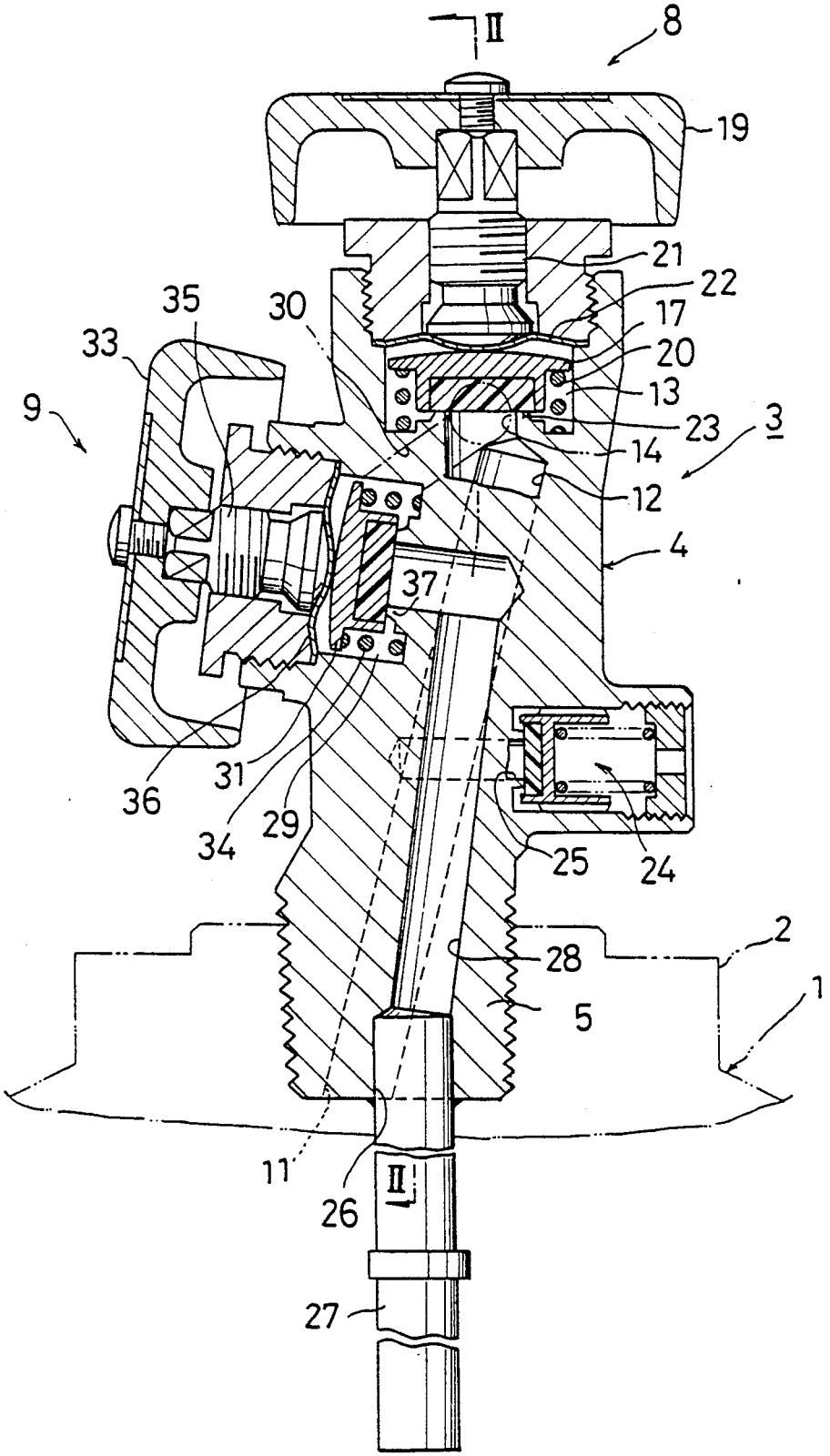
FIGS. 1 through 10 show embodiments of the present invention.
Figure 2:
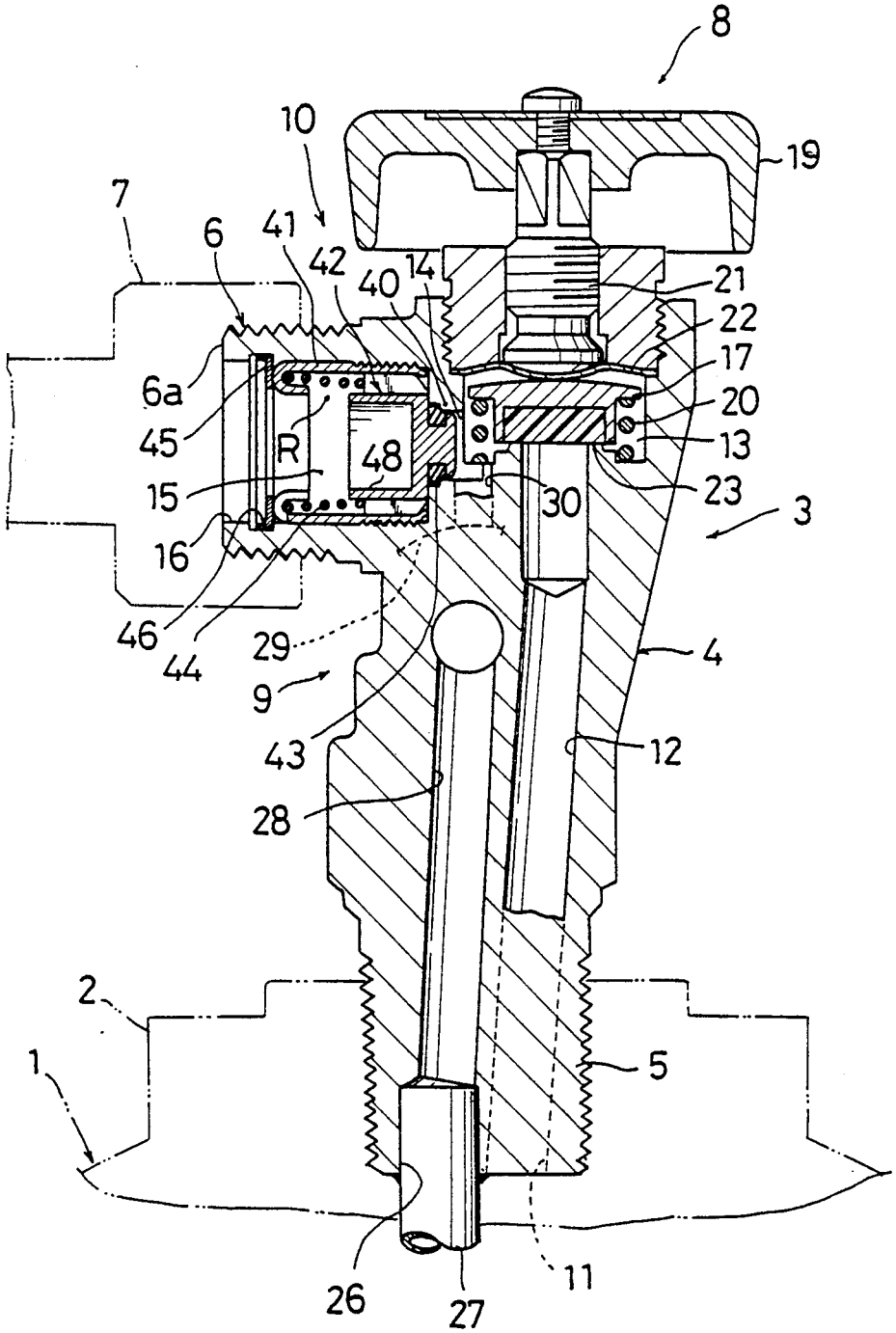

First, an overall construction of a valve device with a check valve will be explained with reference to FIGS. 1 and 2.

A threaded foot portion 5 of a valve box 4 of a valve device 3 is threadably secured to a neck portion 2 of a gas container 1, and a gas outlet nozzle 6 is laterally projected from an upper portion of the valve box 4. In this valve device 3, one gas taking-out mouthpiece 7 connected to the gas outlet nozzle 6 is adapted to be used both for taking out a gas in the vapor phase portion of a liquified gas charged within the gas container 1 and for taking out a liquified gas in the liquid phase portion thereof. The valve box 4 is provided with a gas taking-out stop valve 8, a liquid taking-out stop valve 9 and a check valve 10.

The gas taking-out stop valve 8 is constructed as follows.

A gas inlet port 11, as a vapor phase gas extracting inlet port, is formed in the lower surface of the threaded foot portion 5. This gas inlet port 11 is connected in communication to a gas outlet port 16, in the leading end surface 6*a* of the gas outlet nozzle 6, through an inlet side passage 12, an upward opened stop valve chamber 13, a laterally faced outlet side passage 14 and a check valve chamber 15 in order. A stop valve member 17 is inserted into the stop valve chamber 13 so as to be vertically movable for opening and closing the valve. At the time of the valve closing operation of the stop valve 8, which occurs by turning a handle 19 in the tightening direction, the stop valve member 17 is brought into contact with a stop valve seat 23 through a valve stem 21 and a diaphragm 22 against a resilient force of a valve opening spring 20. On the other hand, at the time of the valve opening operation of the stop valve 8, by turning the handle 19 in the releasing direction, the stop valve member 17 is separated from the stop valve seat 23 by means of the valve opening spring 20 so that the vapor phase gas within the gas cylinder 1 can be taken out of the gas taking-out mouthpiece 7 via the gas inlet port 11, the inlet side passage 12, the stop valve chamber 13, the outlet side passage 14, the check valve chamber 15 and the gas outlet port 16. A gas spout port 25 of a safety valve 24 is connected in communication to the aforementioned inlet side passage 12.

The aforementioned liquid taking-out stop valve 9 is constructed as follows.

A liquid inlet port 26, as a liquid phase gas extraction inlet port, is formed in the lower surface of the threaded foot portion 5 by the side of the gas inlet port 11. A liquid extracting pipe 27 is projected from the liquid inlet port 26 into the lower space of the gas container 1. The liquid inlet port 26 is connected in communication to the outlet side passage 14 through the inlet side passage 28, a upwardly slanted slantly upward opened stop valve chamber 29 and a communication passage 30 in order. A stop valve member 31 is inserted into the stop valve chamber 29 so as to be operable for the valve opening and closing operation. The closing operation of the stop valve 9, is accomplished by turning a handle 33 in the tightening direction. The stop valve member 31 is thus brought into contact with a stop valve seat 37 for valve closing via a valve stem 35 and, a diaphragm 36 against a resilient force of a valve opening spring 34. On the other hand, at the time of valve opening operation of the stop valve 9, which is accomplished by turning the handle 33 in the releasing direction, the stop valve member 31 is separated from the stop valve seat 37 by means of the valve opening spring 34 so that the liquid phase gas within the gas container 1 can be taken out of the gas taking-out mouthpiece 7 through the liquid extracting pipe 27, the liquid inlet port 26, the inlet side passage 28, the stop valve chamber 29, the communication passage 30, the outlet side passage 14, the check valve chamber 15 and the gas outlet port 16.

The aforementioned check valve 10 is constructed as follows.

The gas outlet port 16, the check valve chamber 15, a check valve seat 40 and the outlet side passage 14 are arranged in order from the leading end surface 6*a* of the gas outlet nozzle 6 to a deep portion thereof. That is, a cassette tube 41 is threadably engaged within the gas outlet nozzle 6, and the check valve chamber 15 is formed in the interior of the cassette tube 41. The check valve member 42 is accommodated within the check valve chamber 15 so as to be laterally slidable for the valve opening and closing within a predetermined extent. The check valve member 42 has a valve surface 43 formed in the deep side end surface as its right end surface and also has flow grooves 42*b* and guide ribs 42*c* formed in its tube wall portion 42*a* alternately in the peripheral direction (refer to FIG. 4). The check valve member 42 is resiliently urged to the right valve closing side by means of the valve closing spring 44 which is mounted within a valve opening gap R and is pushed to the left valve opening side against the valve closing spring 44 by means of a gas pressure within the inside space of the check valve seat 40.

An annular plate spring 45 is mounted as a closing member to the left side of the aforementioned cassette tube 41. This plate spring 45 is manufactured from a comparatively brittle material such as a phosphor bronze and is fixedly secured to a spring receiving groove 46 formed in the inner peripheral surface of the gas outlet nozzle 6. When the cassette tube 41 is forcedly taken out by mistake during storage of the gas container 1, the plate spring 45 is apt to be readily broken by the abnormal external force. Thereupon, the breakage state is observed by eyesight, so that it becomes possible to confirm that the check function of the check valve 10 has been lost. As a result, it is possible to readily detect whether or not the interiors of the collected gas containers have been contaminated by an outside air or by foreign substances and thus it is easy to judge whether or not a cleaning is required for the gas containers.

The construction for forcedly opening the aforementioned check valve will be explained with reference to FIGS. 3 and 4.

Figure 3:
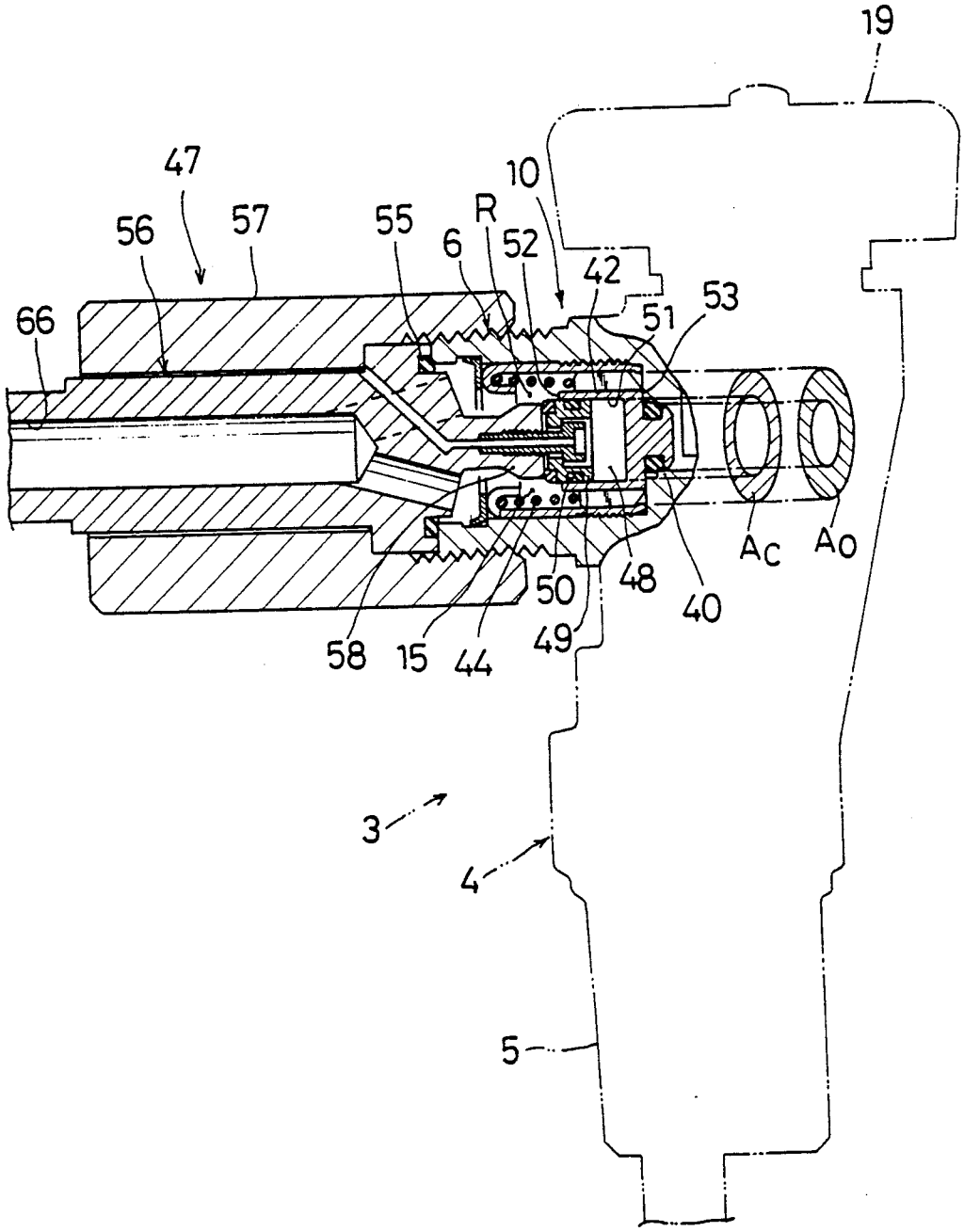
Figure 4:
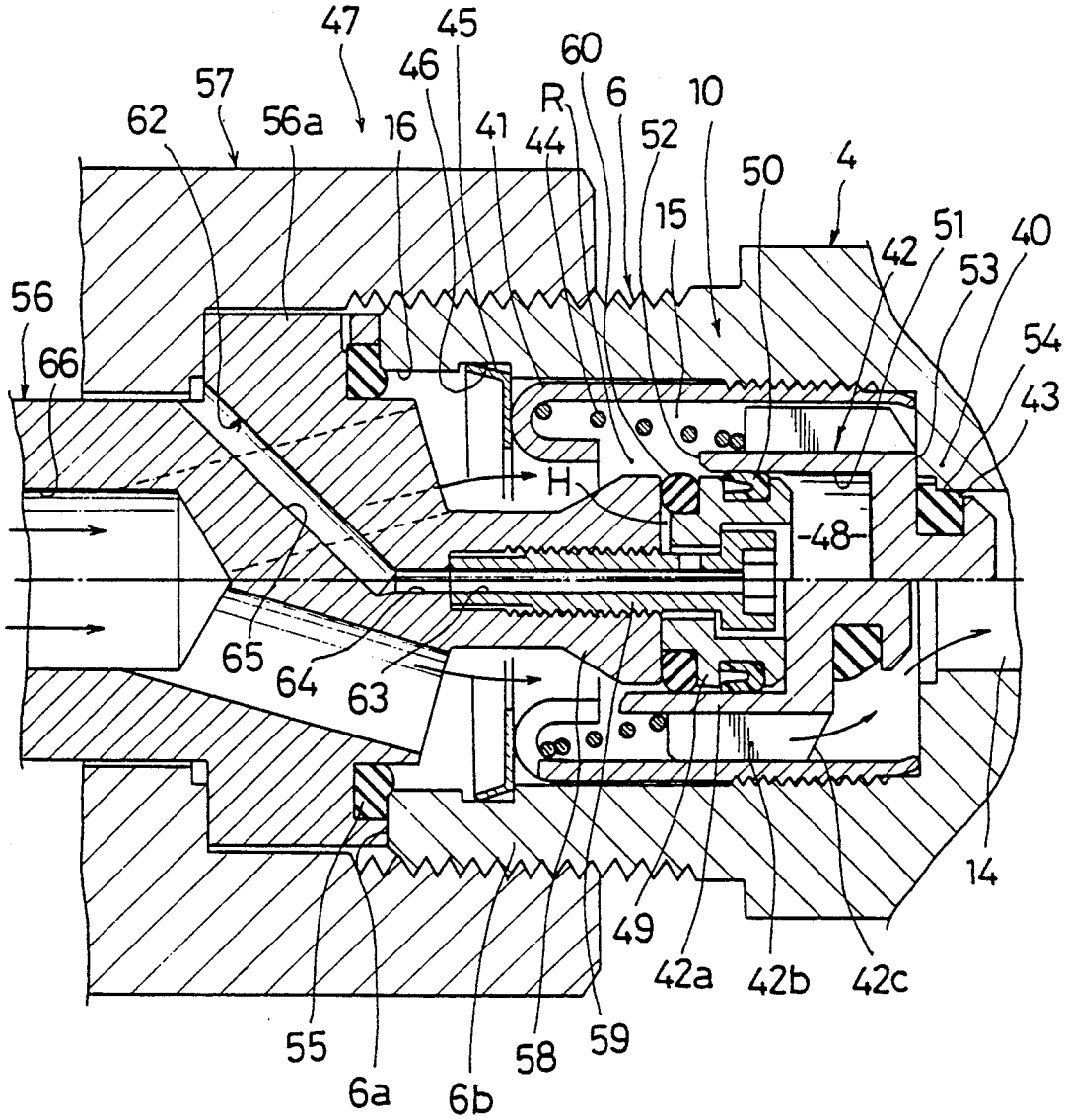

FIG. 3 shows a state where an attachment 47 of a gas charger is connected to the gas outlet nozzle 6 of the valve device 3. FIG. 4 is an explanatory view of the operations of the check valve 10 and the attachment 47. The upper half of FIG. 4 shows a starting condition of a gas charging and the lower half of FIG. 4 shows a valve-opened condition of the check valve member 42.

A received pressure removing cylinder room 48 is formed in the left end surface of the check valve member 42 so as to face rightward in the concaved manner.

A valve-opening piston 49 is detachably inserted into the received pressure removing cylinder room 48 so as to be sealingly movable through a U-packing 50 as a first sealing member. Further, the check valve member 42 is provided at its left surface with a valve-closing pressure receiving surface 52 and at its right surface with a valve-opening pressure receiving surface 53 respectively. The left valve-closing pressure receiving surface 52 is formed in the annular shape diametrically outside a slide fitting surface 51 of the check valve member 42, with which the valve-opening piston 49 is slidably engaged. The right valve-opening pressure receiving surface 53 is formed in the annular shape diametrically outside a valve-closing contact surface 54 which is formed in the check valve member 42 so as to be brought into contact with the check valve seat 40. A valve-opening pressure receiving area $A_o$ of the valve-opening pressure receiving surface 53 is set larger than a valve-closing pressure receiving area $A_c$ of the valve-closing pressure receiving surface 52.

When the gas container 1 is charged with the liquified gas, a gas charging mouthpiece 56 of the attachment 47 is sealingly connected to the gas outlet nozzle 6, by means of a cap nut 57 as a connecting means, and through a gasket 55. A piston supporting member 58 is projected toward the check valve chamber 15 from the right leading end portion of the gas charging mouthpiece 56. The aforementioned valve-opening piston 49 is supported by the piston supporting member 58 through a supporting bolt 59 so as to be freely movable within a certain extent in the diametrical direction, as well as to be freely movable within a certain extent in the axial direction. An axial free gap H between the valve-opening piston 49 and the piston supporting member 58 is sealed by means of an O-ring 60 as a second sealing member. This O-ring 60 is disposed externally around the valve-opening piston 49 on the left side of the U-packing 50. Therefore, the valve-opening piston 49 is allowed to deviationally swing in the spherical direction with respect to the piston supporting member 58. Further, the received pressure removing cylinder room 48 is in communication with the outside air through a communication passage 62. The communication passage 62 comprises a communication bore 63 in the supporting bolt 59, a communication bore 64 in the piston supporting member 58 and a communication bore 65 in a flange portion **56*a* of the gas charging mouthpiece 56**.

The attachment 47 constructed as mentioned above functions as follows.

Before the gas charging work, the check valve member 42 moves diametrically downward by means of gravity due to the existence of a fitting clearance between the peripheral wall of the cassette tube 41 and the check valve member 42, and its axis is laid below the axis of the cassette tube 41.

During the gas charging work, the gas charging mouthpiece 56 is inserted into the bore surrounded by the peripheral wall **6*b* of the gas outlet nozzle 6. Thereupon, as shown in the upper half figure in FIG. 4, the leading end portion of the valve-opening piston 49 is guided by the slide fitting surface 51 of the check valve member 42 so as to advance into the cylinder room 48. Then, the flange portion 56*a* of the gas charging mouthpiece 56 is brought into contact with the leading end surface 6*a* of the gas outlet nozzle 6. Subsequently, the gas charging mouthpiece 56 is fixedly secured to the peripheral wall 6*b* of the gas outlet nozzle 6 by means of the cap nut 57. Under this condition, the fresh gas to be charged is supplied to the gas charging bore 66 of the gas charging mouthpiece 56 from the gas storage apparatus (not illustrated) and sent under pressure into the check valve chamber 15 (refer to the arrow in FIG. 4). Thereupon, a differential force corresponding to an area difference between the valve-opening pressure receiving area $A_o$ and the valve-closing pressure receiving area $A_c$ in FIG. 3 is leftward applied to the check valve member 42. As a result, the differential force overcomes the resilient force of the valve-closing spring 44, so that the check valve member 42 is separated from the check valve seat 40 as shown in the lower figure in FIG. 4. Thereby, the fresh gas is allowed to flow into the outlet side passage 14 from the check valve chamber 15**.

As mentioned above, since the valve-opening piston 49 is mounted to the gas charging mouthpiece 56 through the piston supporting member 58, so as to be movable together with the mouthpiece 56, an operation for inserting the valve-opening piston 49 into the cylinder room 48 and an operation for fixedly securing the gas charging mouthpiece 56 to the gas outlet nozzle 6 can be continuously performed. Accordingly, it is not troublesome to perform the connecting operation of the attachment 47. In addition, if the axis of the gas charging mouthpiece 56 becomes offset, during connection, with respect to the axis of the cylinder room 48 the fitting clearance provided between the flange portion **56*a* of the gas charging mouthpiece 56 and the inner peripheral surface of the cap nut 57, will subject the valve-opening piston 49 to an insertion resistance from the slide fitting surface 51 and will automatically move for alignment in the diametrical direction relative to the piston supporting member 58. Thereby, the cylidrical wall portion 42*a* of the check valve member 42 can be prevented from being held by the gas charging mouthpiece 56 against the peripheral wall 6*b* of the gas outlet nozzle 6. As a result, even though the U-packing 50 as the first sealing member may become hard due to a property change after a long time or from a lack of lubrication, the check valve member 42 can be smoothly opened by means of the pressure of the fresh gas and the erroneous valve-opening can be prevented for a long time. Therefore, the improvement of the working efficiency of the connecting efficiency of the attachment 47 and the prevention of improper charging caused by the erroneous valve-opening of the check valve member 42** can be made compatible.

Further, when a valve-opening and valve-closing frequency of the check valve member 42 occurs over a long period of time during the use of the valve device 3, the fitting clearance between the check valve member 42 and the cassette tube 41 gradually gets larger, extremely little by little, due to the sliding thereof. Therefore, it may occassionally happen that the check valve member 42 kept in the closed state before the gas charging has its axis inclined by means of a resilient force exerted irregularly by the valve closing spring 44. Since the valve-opening piston 49 is supported by the piston supporting member 58 through the O-ring 60 as the second sealing member so as to be deviationally swingable during the connecting work of the gas charging mouthpiece 56, the piston 49 automatically deviates so as to align the axes owing to the insertion resistance provided by the slide fitting surface 51 when being inserted into the cylinder room 48 of the check valve member 42 having its axis inclined. Therefore, by restraining an enlargement of the sealing gap between the cylinder room 48 and the piston 49 promoted by the inclinations of both the axes, it is possible to prevent a lacking of a sealing deformation of the U-packing 50 as the first sealing member. Accordingly, the erroneous valve opening of the check valve member 42 can be surely prevented by preventing the intrusion of the charge gas into the cylinder room 48 during the gas charging.

Further, at the time of gas charging, the valve-opening piston 49 works as follows. In a state where the valve-opening piston 49 has been inserted into the cylinder room 48 before the gas charging, as shown in the upper half figure in FIG. 4, the O-ring 60 as the second sealing member is kept in a resiliently pre-pressed condition between the valve-opening piston 49 and the piston supporting member 58 so as to seal the free gap H in the axial direction of the valve-opening piston 49. When the gas charging is commenced, first, the inner pressure of the check valve chamber 15 increases so that the valve-opening piston 49 tends to be pushed and moved rightward. Thereupon, since the pushing force is received by the piston supporting member 58 through the supporting bolt 59, the sealing function of the O-ring 60 can be maintained so that the charge gas doesn't enter the aforementioned free gap H. When the inner pressure of the check valve chamber 15 increases to a predetermined pressure, as shown in the lower half figure in FIG. 4, the check valve member 42 is moved leftward for valve-opening by means of a differential pressure between both the charge gas pressures exerted onto the left and the right pressure receiving surfaces 52, 53, respectively, and subsequently, the check valve member 42 pushes the valve-opening piston 49 leftward so as to resiliently press the O-ring 60. Thereby, the aforementioned axial free gap H is effectively sealed so as to prevent the charge gas from entering the cylinder room 48 from the free gap H. In addition, the O-ring 60 is swelled diametrically outward so as to effectively seal the slide fitting surface 51 of the cylinder room 48. Thereby, it is possible to effectively prevent the fresh gas from entering the cylinder room 48 from either the free gap H or the slide fitting surface 51 during the gas charging. As a result, it is possible to surely prevent an erroneous charging operation when the check valve member 42 is closed in the middle of gas charging.

On the other hand, the U-packing 50 as the first sealing, member may lose its sealing function due to a bit of a foreign substance and/or a wear caused overtime by the valve-opening and valve-closing of the check valve member 42. In this case if a little amount of charge gas enters the cylinder room 48 due to the damage of the U-packing 50 at the starting of gas charging, it becomes possible to prevent an increasing of the inner pressure of the cylinder room 48 because the entered gas is adapted to be released outside through the aforementioned communication passage 62. Thereby, it becomes possible to more surely prevent the erroneous valve-opening of the check valve member 42.

Incidentally, though the valve device 3 of the aforementioned embodiment is provided with two stop valves of the gas taking-out stop valve 8 and the liquid taking-out stop valve 9, one of these stop valves may be omitted so as to apply the present invention to the same valve device as those in the conventional embodiments.

The first sealing member 50 may be other kinds of packings such as O-rings instead of the U-packing. The second sealing member 60 may be other kinds of packings instead of the O-ring.

Further, though the second sealing member 60 may merely serve to seal the gap provided between the valve-opening piston 49 and the piston supporting member 58, however it is preferable that the second sealing member 60 have such functions as deviationally swingably supporting the valve-opening piston 49 and also as sealing the axial free gap H as mentioned above, in addition to its own sealing function.

SECOND EMBODIMENT

Figure 5:
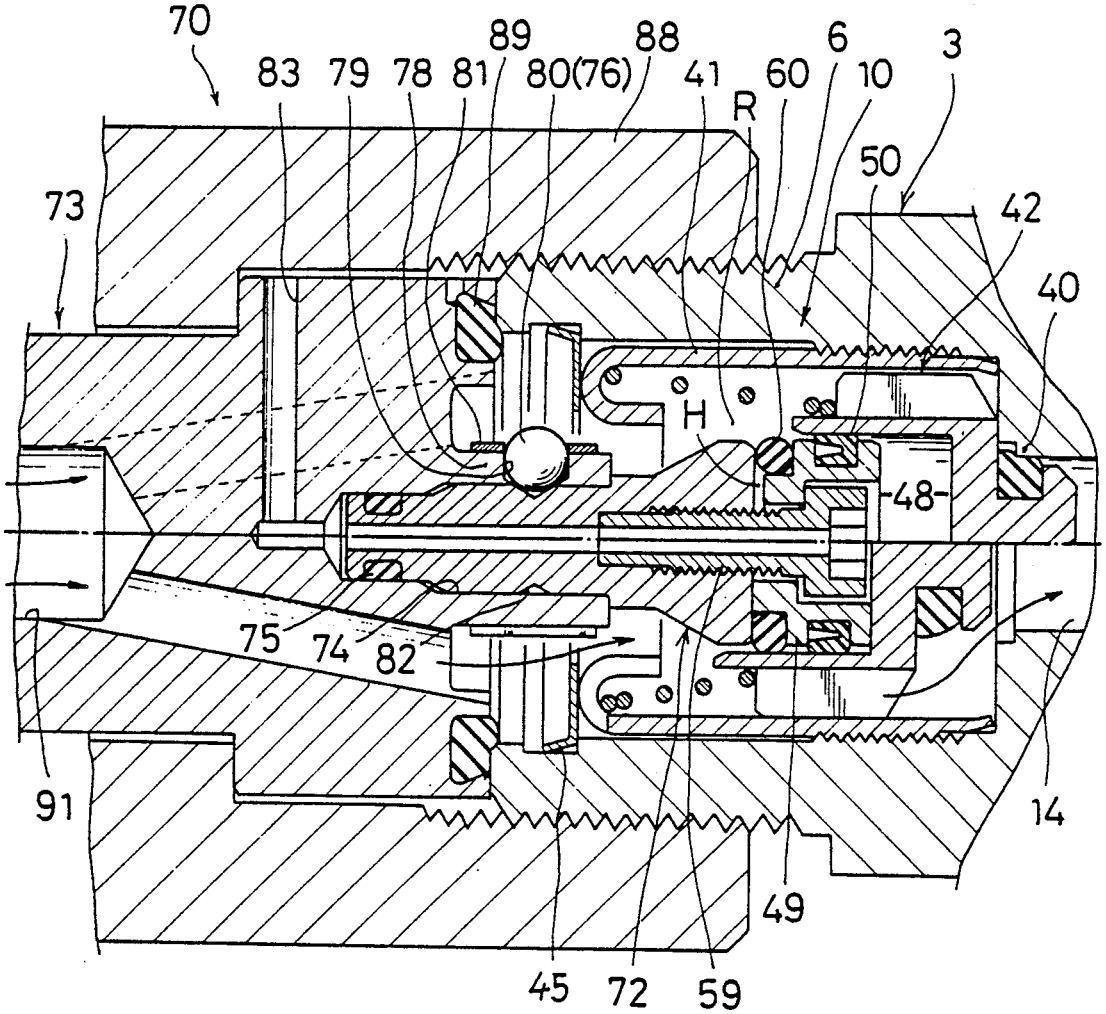
Figure 6:
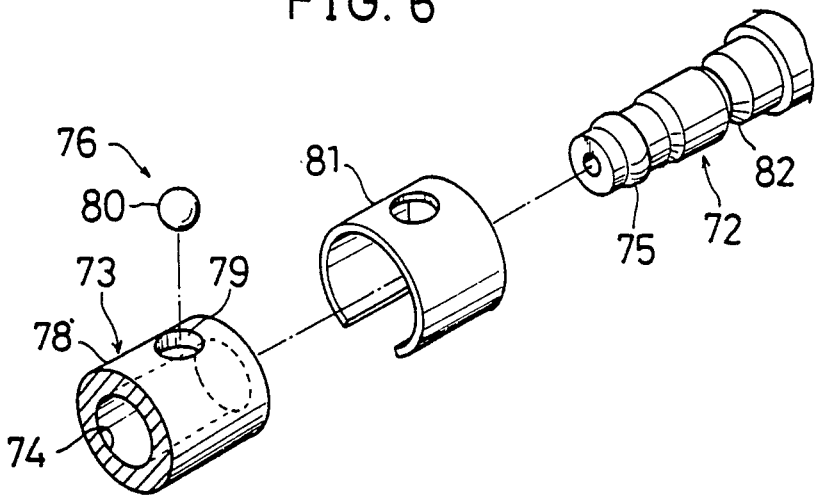
Figure 7:
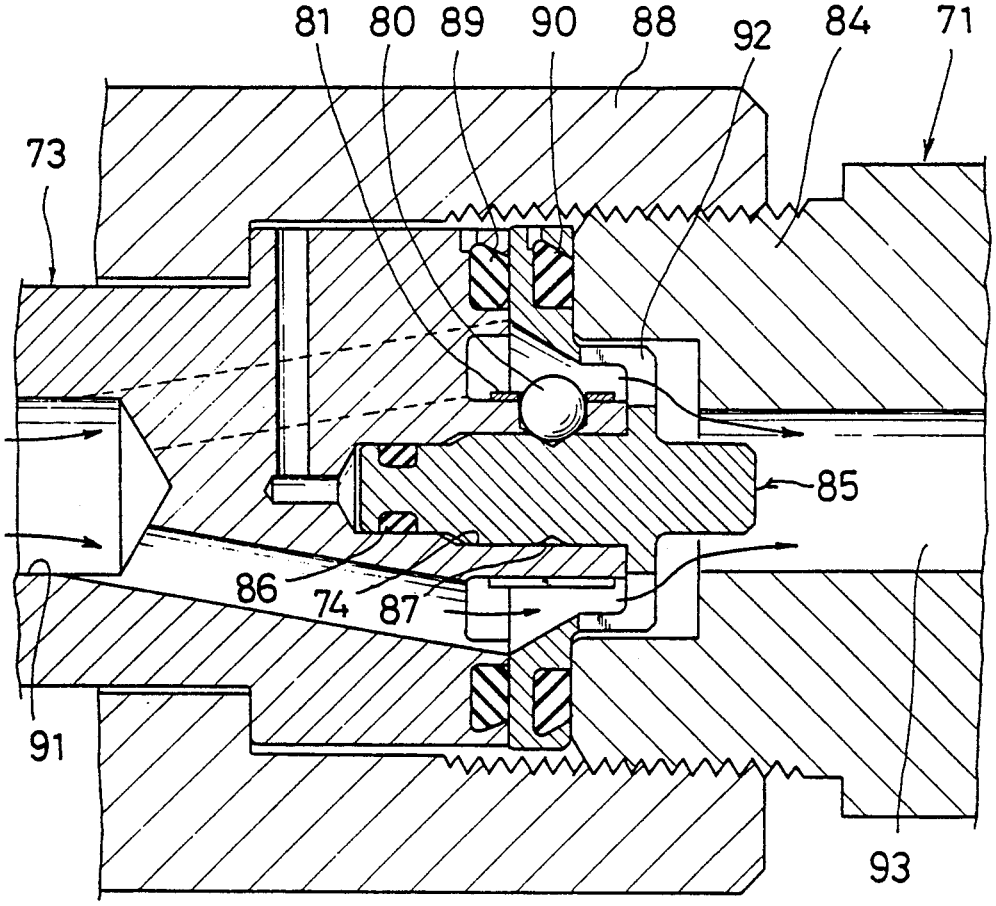

FIGS. 5 through 7 show the second embodiment. In this second embodiment, the valve device 3 with the check valve and the valve-opening piston 49 are constructed in the same manner as those in the above-mentioned first embodiment and indicated with the same symbols as the first embodiment.

An attachment 70 of this second embodiment is so constructed as to be applied to both the valve device 3 with the check valve as shown in FIG. 5 and a valve device 71 without the check valve as shown in FIG. 7.

As shown in FIG. 5, a piston supporting member 72 is separated from a gas charging mouthpiece 73 and detachably mounted to a supporting bore 74 in the leading end portion of the gas charging mouthpiece 73 through an O-ring 75. The piston supporting member 72 is fixedly secured to the gas charging mouthpiece 73 by means of a lock means 76. As shown mainly in FIG. 6, the lock means 76 is provided with a ball receiving bore 79 formed in a cylindrical wall 78 of the gas charging mouthpiece 73, a metal ball 80 to be inserted into the receiving bore 79 and a ball retaining spring tube 81 externally fitted to the cylindrical wall 78 having the ball 80 mounted thereto. When the piston supporting member 72 is inserted into the supporting bore 74 and the ball 80 is engaged with a V-shaped engagement groove 82 of the piston supporting member 72, the axial movement of the piston supporting member 72 is blocked. Similarly as discussed in the aforementioned embodiment, the received pressure removing cylinder room 48 of the check valve member 42 is connected in communication to the outside air through a communication passage 83 formed in both the gas charging mouthpiece 73 and the piston supporting member 72.

The aforementioned attachment 70 is connected as follows, to a gas outlet nozzle 84 of the valve device 71 without the check valve as shown in FIG. 7.

First, the piston supporting member 72 shown in FIG. 5 is detached from the supporting bore 74 of the gas charging mouthpiece 73 against the resilient force of the spring tube 81. Then, as shown in FIG. 7, a plug member 85 is sealingly inserted into the supporting bore 74 through an O-ring 86. Thereupon, the ball 80 is automatically engaged with an engagement groove 87 of the plug member 85 so that the plug member 85 can be fixedly secured to the gas charging mouthpiece 73. Under this condition, the gas charging mouthpiece 73 is fixedly secured to a gas outlet nozzle 84 through a cap nut 88. Thereupon, a gasket 89 is disposed between the gas charging mouthpiece 73 and the plug member 85 to seal them, and another gasket 90 is disposed between the plug member 85 and the gas outlet nozzle 84 to seal them. During the gas charging, the fresh gas is supplied from a gas charging bore 91 of the gas charging mouthpiece 73, to an outlet side passage 93 through a plurality of through-holes 92 of the plug member 85.

As mentioned above, in the case that the attachment 70 is constructed so that the piston supporting member 72 can be replaced with the plug member 85 with respect to the gas charging mouthpiece 73, the attachment 70 can be used also for the valve device 71 without the check valve, which valve device 71 is provided with the gas outlet nozzle 84 having a small inner diameter. Therefore, in the case that a large number of gas containers are charged with the fresh gas at a gas charging station, the gas charging mouthpiece 73 can be used in common even though the valve devices 3 with the check valve and the valve devices 71 without the check valve are mixed therein. As a result, the working efficiency during the gas charging can be enhanced.

Figure 9:
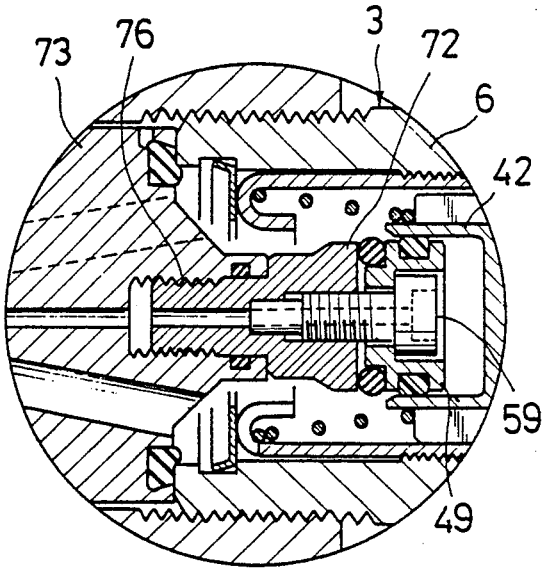
Figure 10:
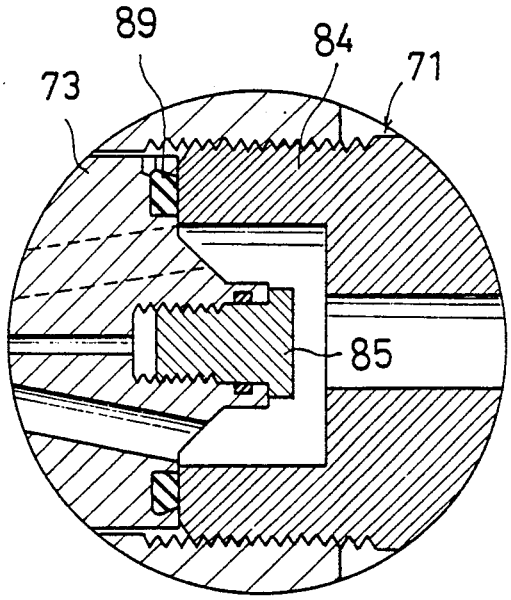
Figure 8:
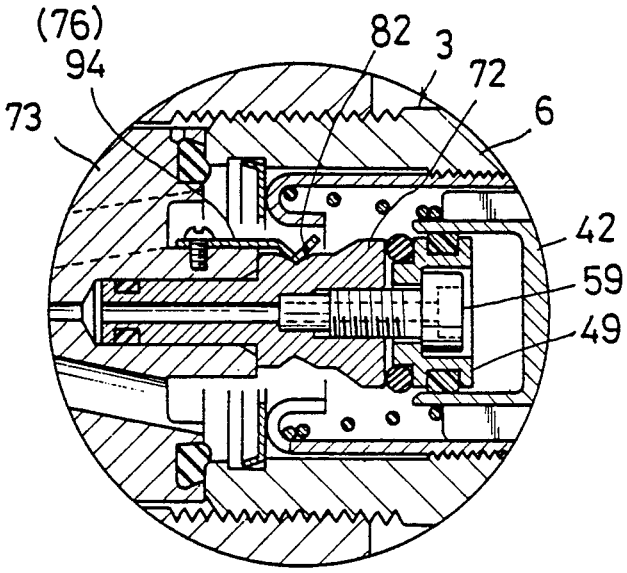
Figure 11:
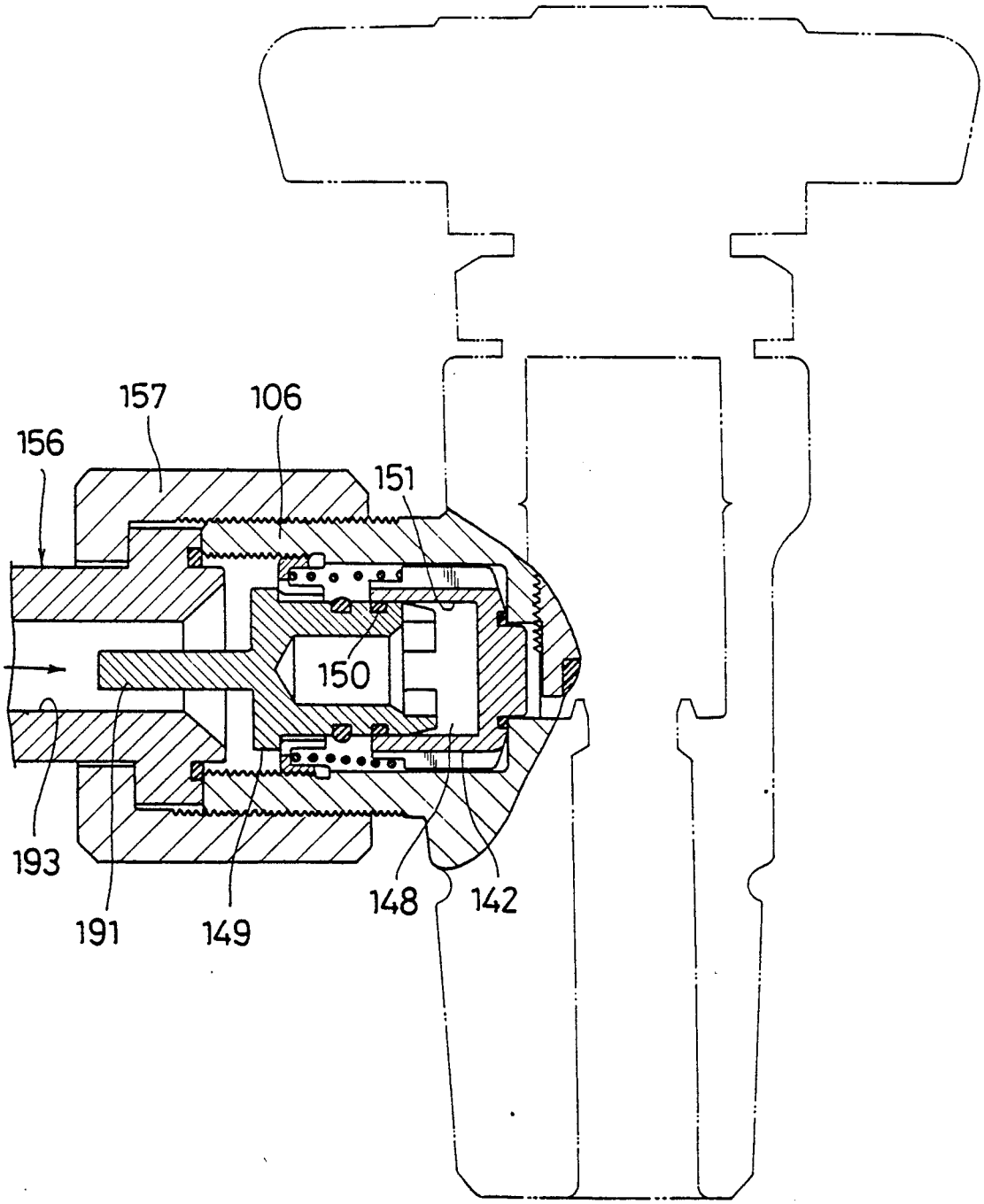
FIG. 11 PRIOR ART
FIGS. 11, 12 and 13 show conventional embodiments respectively and views corresponding to FIG. 3.
Figure 12:
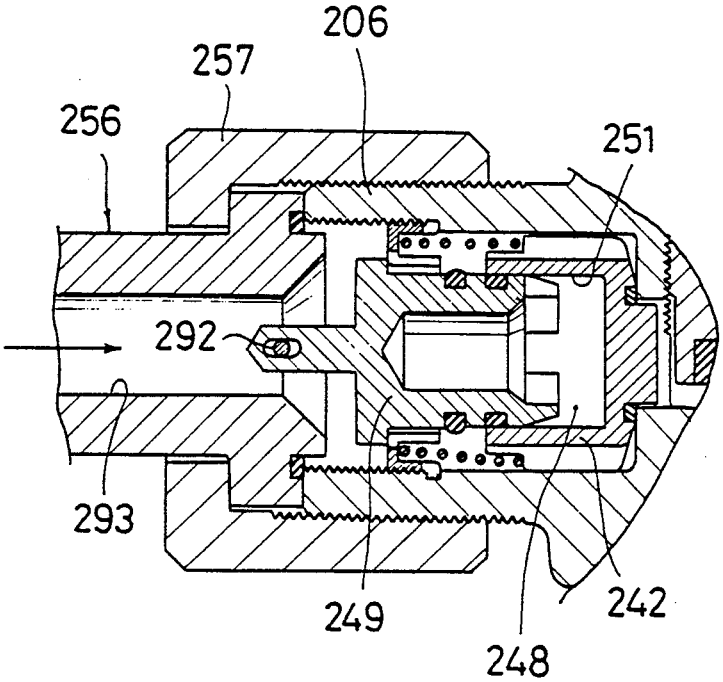
FIG. 12 PRIOR ART
Figure 13:
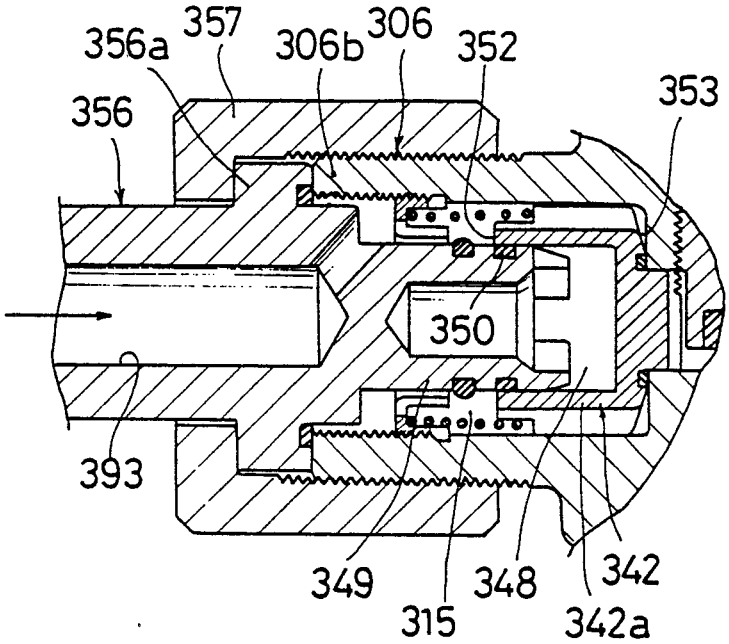
FIG. 13 PRIOR ART

FIGS. 8 through 10 are partial views showing variants of the above-mentioned second embodiment respectively. In each variant, a component member having the same function as that in the second embodiment is indicated with the same symbol thereof.

FIRST VARIANT

FIG. 8 shows a first variant and is a partial view corresponding to FIG. 5. In the lock means 76, a plate spring 94 fixedly secured at its one end to the gas charging mouthpiece 73 is adapted to be engaged at its other end with the engagement groove 82.

SECOND VARIANT

FIG. 9 shows a second variant and is a partial view corresponding to FIG. 5. The lock means 76 comprises threaded fitting portions of the gas charging mouthpiece 73 and the piston supporting member 72.

THIRD VARIANT

FIG. 10 shows a third variant and is a partial view corresponding to FIG. 7. In this embodiment, after the piston supporting member 72 has been detached from the gas charging mouthpiece 73, the plug member 85 is threadably secured to the gas charging mouthpiece 73 so that the gas charging mouthpiece 73 can be connected to the valve device 71 without the check valve. The plug member 85 is manufactured having a small diameter and a short length, and the gas charging mouthpiece 73 and the gas outlet nozzle 84 are directly sealed by means of the gasket 89.

As many different embodiments of the invention will be obvious to those skilled in the art, some of which have been disclosed or referred to herein, it is to be understood that the specific embodiments of the invention as presented herein are intended to be by way of illustration only and are not limiting on the invention, and it is to be understood that such embodiments, variants or modifications may be made without departing from the spirit and scope of the invention as set forth in the claims appended hereto.

What is claimed is:

1. In an attachment of a gas charger for a gas container, adapted to be mounted to a valve device with a check valve having a valve box at the time of fresh gas charging and to allow the charge gas to flow into the gas container when the spring-closed type check valve being forcedly opened by means of a pressure of the charge gas, said check valve having a check valve member and a valve-opening gap, said check valve member having a received pressure removing cylinder room opened in such a condition as facing the attachment, and said valve-opening gap being adapted to allow the check valve member to move for valve-opening toward the attachment, the improvement comprising:

a gas charging mouthpiece having a leading end portion and being detachably sealingly secured to said valve box, a piston supporting member being provided in the leading end portion of said gas charging mouthpiece in such a condition as being movable together therewith in the attaching and detaching direction of the gas charging mouthpiece with respect to the valve box, a valve-opening piston being supported by said piston supporting member in such a condition as being freely movable in the diametrical direction as well as being detachably fitted into said received pressure removing cylinder room, a first sealing member being interposed in a fitting clearance between said received pressure removing cylinder room and said valve-opening piston to seal said cylinder room, a second sealing member being interposed between said valve-opening piston and said piston supporting member to seal therebetween, and wherein said first sealing member and said second sealing member are arranged in order in the valve-opening direction of the check valve member, and said valve-opening piston is deviationally swingably supported by the piston supporting member through the second sealing member.

2. An attachment as defined in claim 1, wherein said piston supporting member is detachably mounted to the gas charging mouthpiece.

3. An attachment as defined in claim 1, wherein said valve-opening piston is supported by the piston supporting member in such a condition as being freely movable in a certain extent in the axial direction, said second sealing member is so disposed as to seal between a free gap provided between the valve-opening piston and the piston supporting member and said fitting clearance provided between the received pressure removing cylinder room and the valve-opening piston, and at the end stage of valve-opening operation of the check valve caused by the charge gas, said check valve member is adapted to press the second sealing member between the valve-opening piston and the piston supporting member so that the second sealing member is swelled outward in the diametrical direction.

4. An attachment as defined in claim 1, wherein a communication passage having openings at its opposite ends is formed in both the gas charging mouthpiece and the piston supporting member, and said communication passage is connected in communication at its one opening to the received pressure removing cylinder room kept in such a condition as being sealed by the valve-opening piston as well as at its other opening to the outside air.

5. A valve device with a check valve for a gas container, which valve device including a spring-closed type check valve disposed within a valve box provided with a gas outlet nozzle, and an attachment having a gas charging mouthpiece and a valve-opening piston and adapted to be mounted to said gas outlet nozzle at the time of fresh gas charging into a gas container and to forcedly separate a check valve member of the check valve from a check valve seat by means of a pressure of the charge gas supplied from said gas charging mouthpiece to allow the charge gas to flow into the gas container, said check valve comprising a cassette tube having an external end portion and adapted to be inserted into said gas outlet nozzle and to be detachably fitted into said valve box, said check valve member having an external end portion and adapted to be axially movably inserted into said cassette tube for the valve-opening and -closing, a valve-closing spring mounted between said external end portion of the check valve member and said external end portion of the cassette tube, a closing member mounted between said gas outlet nozzle and said external end portion of the cassette tube within the gas outlet nozzle and wherein said cassette tube is threadably detachably secured to the valve box, and said closing member is made of an annular brittle spring material and mounted to the gas outlet nozzle.

6. In an attachment of a gas charger for a gas container, adapted to be mounted to a valve device with a check valve having a valve box at the time of fresh gas charging and to allow the charge gas to flow into the gas container when the spring-closed type check valve being forcedly opened by means of a pressure of the charge gas, said check valve having a check valve member and a valve-opening gap, said check valve member having a received pressure removing cylinder room opened in such a condition as facing the attachment, and said valve-opening gap being adapted to allow the check valve member to move for valve-opening toward the attachment, the improvement comprising:

a gas charging mouthpiece having a leading end portion and being detachably sealingly secured to said valve box, a piston supporting member being provided in the leading end portion of said gas charging mouthpiece in such a condition as being movable together therewith in the attaching and detaching direction of the gas charging mouthpiece with respect to the valve box, a valve-opening piston being supported by said piston supporting member in such a condition as being freely movable in the diametrical direction as well as being detachably fitted into said received pressure removing cylinder room, a first sealing member being interposed in a fitting clearance between said received pressure removing cylinder room and said valve-opening piston to seal said cylinder room, and a second sealing member being interposed between said valve-opening piston and said piston supporting member to seal therebetween;

wherein said valve-opening piston is supported by the piston supporting member in such a condition as being freely movable in a certain extent in the axial direction, said second sealing member is so disposed as to seal between a free gap provided between the valve-opening piston and the piston supporting member and said fitting clearance provided between the received pressure removing cylinder room and the valve-opening piston, and at the end stage of valve-opening operation of the check valve caused by the charge gas, said check valve member is adapted to press the second sealing member between the valve-opening piston and the piston supporting member so that the second sealing member is swelled outward in the diametrical direction.

7. In an attachment of a gas charger for a gas container, adapted to be mounted to a valve device with a check valve having a valve box at the time of fresh gas charging and to allow the charge gas to flow into the gas container when the spring-closed type check valve being forcedly opened by means of a pressure of the charge gas, said check valve having a check valve member and a valve-opening gap, said check valve member having a received pressure removing cylinder room opened in such a condition as facing the attachment, and said valve-opening gap being adapted to allow the check valve member to move for valve-opening toward the attachment, the improvement comprising:

a gas charging mouthpiece having a leading end portion and being detachably sealingly secured to said valve box, a piston supporting member being provided in the leading end portion of said gas charging mouthpiece in such a condition as being movable together therewith in the attaching and detaching direction of the gas charging mouthpiece with respect to the valve box, a valve-opening piston being supported by said piston supporting member in such a condition as being freely movable in the diametrical direction as well as being detachably fitted into said received pressure removing cylinder room, a first sealing member being interposed in a fitting clearance between said received pressure removing cylinder room and said valve-opening piston to seal said cylinder room, and a second sealing member being interposed between said valve-opening piston and said piston supporting member to seal therebetween;

wherein a communication passage having openings at its opposite ends is formed in both the gas charging mouthpiece and the piston supporting member, and said communication passage is connected in communication at its one opening to the received pressure removing cylinder room kept in such a condition as being sealed by the valve-opening piston as well as at its other opening to the outside air.

* * * * *